United States Patent [19]

Neu et al.

[11] Patent Number: 4,900,091

[45] Date of Patent: Feb. 13, 1990

[54] ELECTROHYDRAULIC COAL-MINING SYSTEM

[75] Inventors: Gustav Neu, Bochum; Ernst-Günter Nerlich, Essen; Karl-Heinz Berger, Gelsenkirchen-Resse, all of Fed. Rep. of Germany

[73] Assignee: Bochumer Eisenhutte Heintzmann GmbH & Co. KG, Bochum, Fed. Rep. of Germany

[21] Appl. No.: 243,066

[22] Filed: Sep. 9, 1988

[30] Foreign Application Priority Data

Sep. 12, 1987 [DE] Fed. Rep. of Germany ..... 3730711

[51] Int. Cl.[4] ..... E21D 23/12

[52] U.S. Cl. ..... 299/1; 299/10; 299/43; 405/294; 405/302

[58] Field of Search ..... 405/291, 293, 294, 296, 405/299, 302; 299/1, 10, 33, 42, 43

[56] References Cited

U.S. PATENT DOCUMENTS

| | | | |
|---|---|---|---|
| 3,365,893 | 1/1968 | Allen | 405/293 |
| 4,217,067 | 8/1980 | Lagodka et al. | 405/296 |
| 4,427,321 | 1/1984 | Weirich et al. | 405/294 |
| 4,692,067 | 9/1987 | Ward et al. | 405/302 |
| 4,708,394 | 11/1987 | Trox et al. | 299/1 |

*Primary Examiner*—David H. Corbin

*Attorney, Agent, or Firm*—Herbert Dubno; Andrew Wilford

[57] ABSTRACT

A mining system comprises a laterally deflectable segmented conveyor extending longitudinally along a longitudinal face from which material is to be cut, a mining machine displaceable longitudinally along the conveyor and engageable with the face to cut material therefrom and deposit in the conveyor, and a longitudinal succession of support frames each having a respective actuator connected to a respective segment of the conveyor and each also having a respective a respective retractile roof-engaging flap. The process of this invention comprises bracing the frames and conveyor in a safety zone immediately adjacent the mining machine against the roof with their flaps retracted. The machine is advanced in the safety zone while cutting the face in the safety zone, and the flaps of the frames in a zone immediately downstream of the safety zone are sequentially retracted and the flaps of the frames in a zone upstream of the safety zone are sequentially advanced. The number of frames in the upstream and downstream zone is determined by the stability of the material of the mine roof. The conveyor segments are meanwhile pushed toward the face by extension of the actuators of the frames in a second zone immediately upstream of the upstream zone and the frames are themselves drawn toward the face by contraction of the actuators of the frames in a third zone immediately upstream from the second zone.

6 Claims, 2 Drawing Sheets

ELECTROHYDRAULIC COAL-MINING SYSTEM

FIELD OF THE INVENTION

The present invention relates to an electrohydraulic system for mining coal or the like. More particularly this invention concerns such a system used to move a seam cutter, conveyor, and roof props along a seam of coal or the like.

BACKGROUND OF THE INVENTION

It is standard to mine coal from a face by means of a piece of equipment comprising a longitudinal succession of roof props, a limitedly displaceable and deformable conveyor extending longitudinally along the face, and a seam cutter displaceable longitudinally along the face also. The cutter removes material from the face and deposits it in the conveyor which displaces it longitudinally back along the cut. The props each have a base part standing on the floor, a roof part engaging the ceiling, an actuator capable of pushing these parts vertically apart, and a retractable flap that can be extended against the roof toward the face by its own individual actuator. Basically the function of the support flaps is to hold up the ceiling ahead of and behind the seam cutter.

As the seam cutter is moved along the face the support flaps are fully retracted to give it space to work. Behind the seam cutter the props and the conveyor are moved closer to the face, which is moved transversely outward with each pass of the cutter.

Thus in the coal-mining system the operator of the seam cutter controls the system from his or her location behind the seam cutter protected by one of the props. For a cutting operation the operator pushes a start button that fully retracts all the support flaps of a group of props downstream, that is ahead in the cutting direction, of the seam cutter, so that these flaps are not in the way of the cutter. If necessary auxiliary flaps that press against the face are also retracted. Then the cutter is advanced downstream along the face, cutting away the face and depositing the coal, ore, and the like into the conveyor.

Afterward the operator extends the flaps upstream of the cutter to produce a safety or protected zone, these flaps being pushed right up against the face. Thereupon the conveyor is realigned adjacent the face by pushing it with the actuators of the props, which for this function are spanned tight against the roof and floor. Subsequently the props are pulled transversely over toward the conveyor by these actuators, during which time their vertical actuators are relaxed and their flaps are allowed to pull in.

A disadvantage of this system is that the control is always exercised groupwise, that is the succession of props are operated in groups that must each include the same number of such props. The minimum group size is determined by the minimum number of props that must be used to deflect the conveyor, and this number is in turn a function of the deflectability of this conveyor. Unfortunately, when the rock or earth in which the face is being cut is not particularly stable, this can lead to modest cave-ins upstream and downstream of the mining machine when the support flaps are retracted, as the amount of unsupported ceiling is just too extensive to hold.

Thus it is often necessary to reduce the group size to an absolute minimum. This means that the conveyor will be deflected very greatly, putting a substantial strain on the joints between the individual jointed segments of this conveyor. In addition the mining efficiency drops as a relatively small bit is taken with each forward step of the mining machine, or with each backward step depending on which way the machine is working.

OBJECTS OF THE INVENTION

It is therefore an object of the present invention to provide an improved system for operating such a mining machine.

Another object is the provision of such an improved system for operating such a mining machine which overcomes the above-given disadvantages, that is which allows the machine to adapt to different operating conditions.

SUMMARY OF THE INVENTION

The process of this invention is used, as described above, with a mining system comprising a laterally deflectable segmented conveyor extending longitudinally along a longitudinal face from which material is to be cut, a mining machine displaceable longitudinally along the conveyor and engageable with the face to cut material therefrom and deposit it in the conveyor, and a longitudinal succession of support frames each having a respective actuator connected to a respective segment of the conveyor and each also having a respective retractile roof-engaging flap. The process of this invention comprises bracing the frames and conveyor in a safety zone immediately adjacent the mining machine against the roof with their flaps retracted. The machine is advanced in the safety zone while cutting the face in the safety zone, and the flaps of the frames in a zone immediately downstream of the safety zone are sequentially retracted and the flaps of the frames in a zone upstream of the safety zone are sequentially advanced. The number of frames in the upstream and downstream zone is determined by the stability of the material of the mine roof. The conveyor segments are meanwhile pushed toward the face by extension of the actuators of the frames in a second zone immediately upstream of the upstream zone and the frames are themselves drawn toward the face by contraction of the actuators of the frames in a third zone immediately upstream from the second zone.

According to this invention these steps are all triggered from a neutral location in the safety zone, and once they are started they all take place automatically, upstream and downstream of this neutral location. It is therefore a substantial feature of the invention that starting from this neutral location it is possible to determine how many frames to use in each zone according to local conditions and equipment parameters. Thus some zones can be short and some long, according to requirements. Normally the zones immediately upstream and downstream of the safety zone are kept as short as possible to avoid cave-ins. On the other hand the zone in which the conveyor is deflected is kept relatively long so that damage to the segment joints of the conveyor and excessive distortion of the conveyor belt are avoided. The sizes of the zones are largely independent of one another.

The safety zone defines the preceding downstream group of frames and the following upstream group and itself is defined by one of the frames. It is from this neutral- or safety-zone frame that the method is directed from.

The entire setup can be preprogrammed while still leaving it to the operator to change some parameters, such as the size of the zones immediately flanking the safety zone.

According to this invention the frame which constitutes the starting point, with the upstream and downstream frames all doing whatever their zones require and the zones moving, can be set anywhere in the safety zone. Normally this neutral zone or starting point is right at the seam cutter, although it can also be set at one of the frames. When the neutral zone moves, all of the zones and so on also move, of course, synchronously with the normally slowly moving mine machine. In face the machine operator might move from one frame to the immediately adjacent frame, or skip frames or even move to every third or fourth frame, as the process advances. In any case the individual frames are individually operated, not in groups as in the prior-art systems.

According to this invention the steps of the invention are carried out at specific time intervals. They can also be triggered by one another, that is the retraction of one flap can trigger the retraction of the upstream flap and so on. In addition the steps can be triggered from above ground, in which case the positions of the flaps and frames are transmitted above ground from appropriate sensors and are then used to trigger the various steps of this invention. Thus the below-ground people can be mere observers, with actual control being exercised from above ground.

Whenever a disturbance is sensed the entire process is arrested, including advance of the seam cutter. This is a substantial safety feature that is made possible by the central neutral-zone control.

DESCRIPTION OF THE DRAWING

The above and other objects, features, and advantages will become more readily apparent from the following, reference being made to the accompanying drawing in which.

SPECIFIC DESCRIPTION

Figure 1:
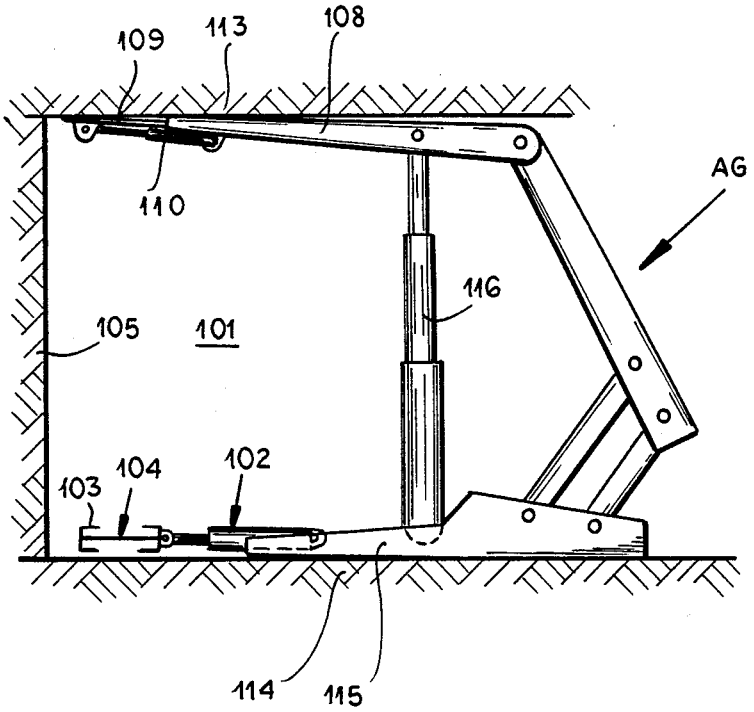
FIG. 1 is a side view of a roof support or prop of the mining system of this invention.

As seen in FIG. 1 a support frame or prop AG for holding up the roof or ceiling 113 above the floor 114 of a mine 101 adjacent a face section 105 comprises an upper roof-engaging part 108, a lower floor-engaging part 115 and an upright cylinder or actuator 116 engaged between them. The upper part 108 carries a support flap 109 that can be advanced by a cylinder 110. The lower part 115 is connected via a lateral-movement cylinder or actuator 102 to a section 103 of a conveyor 104 that also serves as shown in FIG. 2 as the longitudinal guide or track for a two wheel mining machine 107 whose upper wheel 112 is shown.

Figure 2:
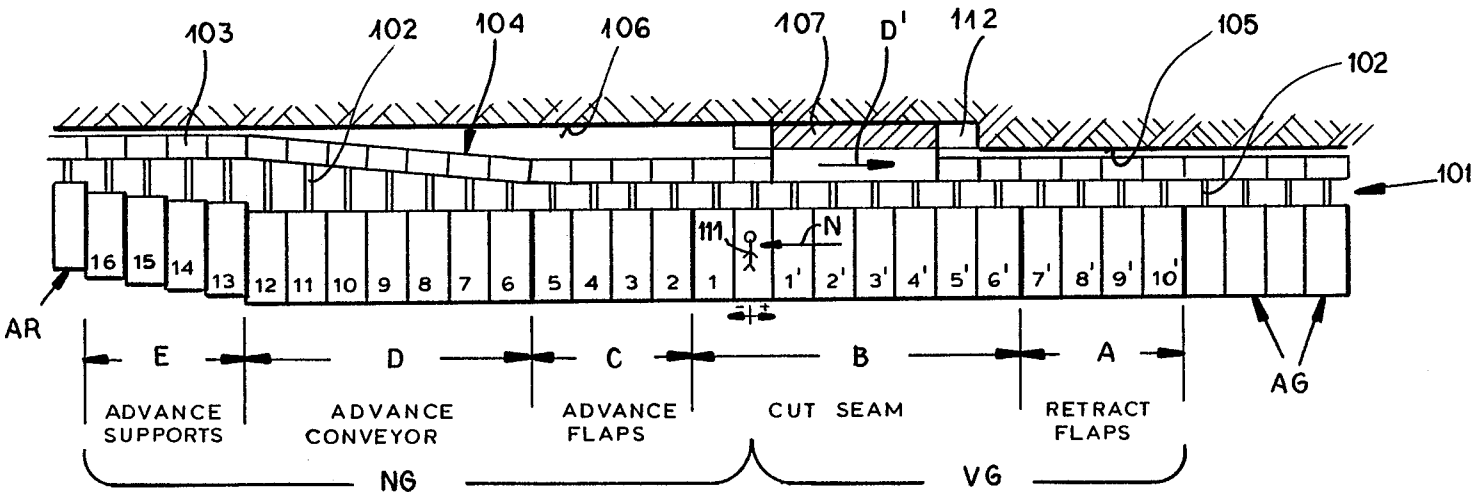
FIG. 2 is a small-scale and largely schematic top view illustrating the system of the present invention.

FIG. 2 shows a succession of such frames AG extending in a longitudinal row along the face 105, 106 adjacent the conveyor 104. The action can be directed from above ground or from a neutral location N for a machine operator 111 provided slightly downstream in the displacement direction D of the mining machine 107. In any case, one the sequence is started, all operations follow automatically.

In the illustrated embodiment there are ten frames AG numbered 1' through 10' in a group VG downstream of the neutral location N and sixteen frames AG numbered 1 through 16 in a group NG upstream of the station N. The two groups VG and NG are formed by five subgroups A through E.

The system operates as follows:

Once the cycle is started by the operator 11 the flaps 109 of the frames AG7'–AG10' in the zone A are retracted sequentially, starting with frame 7 at 5sec intervals, thereby leaving the ceiling 113 clear for the upper cutter 112 of the machine 107 which is advanced at a rate equal to the longitudinal length of a frame AG each 5 sec.

During this sequential retraction of the flaps 109 in the zone A the flaps are sequentially advanced in the zone C which contains the frames AG2 through AG5. Thus as the flap of frame AG7' is retracted, the flap 109 of frame AG5 is advanced, and so on.

Meanwhile in the zone B between the zones A and C the face is being cut back from 105 to 106. In this region the actuators 116 are under pressure to hold up the roof 113 and to insure that the conveyor/guide 104 is solidly anchored so the machine 7 can ride along it. This safety zone B is formed here by the frames AG1, AG1'–AG6', and by the neutral station N which, as indicated by the ± can be of any selected length depending on the stability of the material being cut and so on. The longitudinal length of the zone B is predetermined, but that of the zones A and C, which are normally identical, can be determined by the operator.

Simultaneously with the flap retraction and advance in the zones A and C, respectively, the actuators 102 in the frames AG6–AG12 of the zone D are pressurized to deflect the conveyor/guide 104 toward the face 16. In this zone D the flaps 109 remain tight against the ceiling 113 as the conveyor 104 underneath moves laterally.

Finally in zone E the rams 116 are sequentially or individually relaxed somewhat and the actuators 102 contracted to pull the frames AG13–AG16 over into position against the newly cut face 105, during which action the flaps 109 are allowed to retract. Once in the position AR the actuators 116 are again pressurized to fully support the mine roof. Once again, the movement in the zone E can be synchronous with that in the other zones or somewhat later.

Thus at its simplest the system of the instant invention comprises retracting the support flaps of the frames downstream of the advancing cutter, while sequentially advancing the flaps upstream and also upstream resetting the conveyor.

Instead of using the above-described timer-type control, it is possible to control the machine by events. Thus position sensors in adjacent frames AG trigger actions in the adjacent frames or at a distance therefrom determined by the program.

In any case according to the invention the number of frames in each function zone A through E can be specifically tailored to specific circumstances. In any case the size of the zones A and C is minimized so that the roof edge is only left unsupported for a short distance ahead of and behind the cutter 107. On the other hand the safety zone B can be made of whatever length is advantageous for this cutter 107, and the zone D can be made rather long to take the strain off the joints between segments 103 of the conveyor/guide 104.

If the operator 111 leaves the neutral zone N it is not strictly necessary that he move in underneath the immediately adjacent frame AG. Instead he can move up two or more frames and restart the cycle, in which case his new position determines the relative positions of the zones A through E.

We claim:

1. A process for operating a mining system comprising:

a laterally deflectable segmented conveyor extending longitudinally along a longitudinal face from which material is to be cut;

a mining machine displaceable longitudinally along the conveyor and engageable with the face to cut material therefrom and deposit it in the conveyor; and a longitudinal succession of support frames each having a respective actuator connected to a respective segment of the conveyor and each also having a respective retractile roof-engaging flap, the process comprising the steps of:

(a) bracing the frames and conveyor in a safety zone extending longitudinally past a plurality of the frames immediately adjacent the mining machine against the roof with their flaps retracted;

(b) advancing the machine in the safety zone while cutting the face in the safety zone;

(c) sequentially retracting the flaps of the frames one frame at a time in a zone immediately downstream of the safety zone as the machine is advanced;

(d) sequentially advancing the flaps of the frames one frame at a time in a zone immediately upstream of the safety zone as the machine is advanced;

(e) pushing the conveyor segments toward the face by extension of the actuators of the frames one frame at a time in a second zone immediately upstream of the upstream zone;

(f) drawing the frames toward the face by contraction of the actuators of the frames one frame at a time in a third zone immediately upstream from the second zone; and (g) selecting the number of frames in the upstream and downstream zone in accordance with the stability of the material of the mine roof.

2. The process defined in claim 1 wherein steps (c) through (f) are carried out at specific time intervals.

3. The process defined in claim 2 wherein each of steps (c) through (f) trigger one another.

4. The process defined in claim 1 wherein steps (c) through (f) are triggered from above ground.

5. The process defined in claim 4 wherein the positions of the flaps and frames are transmitted above ground and used to trigger steps (c) through (f).

6. The process defined in claim 1 wherein the upstream and downstream zones contain the same numbers of frames and the flaps in the upstream zone are retracted synchronously as the flaps in the downstream zone are advanced.

* * * * *